US010524499B2

(12) United States Patent
Wander

(10) Patent No.: US 10,524,499 B2
(45) Date of Patent: Jan. 7, 2020

(54) CIGARETTE TIP

(71) Applicant: Joseph M Wander, Ft Lauderdale, FL (US)

(72) Inventor: Joseph M Wander, Ft Lauderdale, FL (US)

( * ) Notice: Subject to any disclaimer, the term of this patent is extended or adjusted under 35 U.S.C. 154(b) by 0 days.

(21) Appl. No.: 15/959,052

(22) Filed: Apr. 20, 2018

(65) Prior Publication Data

US 2019/0320711 A1 Oct. 24, 2019

(51) Int. Cl.
*A24D 3/04* (2006.01)
*A24D 3/02* (2006.01)

(52) U.S. Cl.
CPC ..... *A24D 3/043* (2013.01); *A24D 3/0212* (2013.01); *A24D 3/0245* (2013.01); *A24D 3/0266* (2013.01); *A24D 3/0275* (2013.01)

(58) Field of Classification Search
None
See application file for complete search history.

(56) References Cited

U.S. PATENT DOCUMENTS 2,035,398 A * 3/1936 Wilhelm Muller .. A24D 3/0245 131/361
4,583,560 A * 4/1986 Sakai ..... A24D 3/043 131/336
9,179,706 B2 * 11/2015 Jespersen ..... A24C 5/40
2016/0143349 A1 * 5/2016 Fallon ..... A24D 1/02 131/280

* cited by examiner

*Primary Examiner* — Michael J Felton
*Assistant Examiner* — Katherine A Will
(74) *Attorney, Agent, or Firm* — Christopher J Van Dam PA.; Chris Vandam

(57) ABSTRACT

A backing with corrugations on a first surface. The corrugations are parallel and each has an airspace along an entire longitudinal length. A second surface of the backing includes perforations or scores oriented perpendicularly or parallel to the corrugations. The corrugations or scores are fold lines or frangible tear lines. The airspaces may also include a filter material. The second surface of the backing may be adhered to a corner of a rolling paper on the surface but opposite edge as a gum strip. The corrugations are parallel to the gum strip.

1 Claim, 2 Drawing Sheets

CIGARETTE TIP

BACKGROUND OF THE INVENTION

1. Field of the Invention

The present invention relates to cigarette filters, and more particularly, to an improved filter for personal rolling of cigarettes.

2. Description of the Related Art

Several designs for cigarette filters have been developed in the past. None of them, however, includes a corrugated sheet provided with perforations to allow easier forming into a roll or to separate sections of the sheet for customized use. Other filters use a pre-sized cotton or fiber filter that is not readily adaptable to hand rolling cigarettes.

A smoking stick has two ends, one that is ignited and the other which the smoker sucks through. Smokers that choose to roll their own cigarettes often decide to pack down the filler material (i.e. tobacco). Packing means to condense the filler material inside the paper that was recently rolled into a cylinder or cone shape. During the packing process the end that goes into the mouth is closed off or blocked or plugged by using a tip or filter that can be smoked through.

A tip is inserted or rolled into a smoking stick at the suction end. A tip will not bend as easily as the paper used to roll the smoking stick and is used at the suction end of any hand or machine rolled smoking stick. Ideally a tip would allow air to pass through easily when the smoking stick is ignited and allow none or little filler to pass through during the packing process.

There are three general prior art methods of packing:

1. To push something in the opposite end of a filter or tip. This is traditionally done in combination with one of the other two methods.
2. To grab the top end, or the end opposite the filter or tip with your thumb and index finger and while holding it up in the air shake it back and forth.
3. To drop on or hit the filter or tip end straight down on a hard surface.

Other prior art attempts at containing the tobacco in the rolled cigarette at the draw end generally comprise folding or rolling a small section or square of cardstock or other paper into a small coil or accordion. The rolled cardstock is then placed into the draw end of the cigarette when rolling the cigarette. The paper is generally a little stiffer or thicker than the cigarette paper itself and is not intended to be burned with the cigarette. This method produces inconsistent results and requires some skill to execute. This method does not have the several consistent channels to guide the smoke to the user as shown in the present invention.

Only cotton filters, which are becoming less and less desirable, can prevent loss of filler during any packing method both described or not. Another problem is while the smoker is packing their smoke the filler can also fall out the back while smoking. The zigzag or accordion method described above does not completely stop this from happening.

Currently, in the field of roll your own smoking products, there is nothing that serves as both a disposable tip and catch without folding back and forth to form the zigzag or accordion tip. This can be seen with cardboard like flat tabs that are available with some packs of rolling papers or stacks of rectangular tabs sold separately.

When not making a catch and simply making a tip almost any rectangular piece of paper thicker then the rolling paper can be rolled into a cylinder to form a tip or mouthpiece. If a smoker tears paper of equal thickness to the tips sold currently and then fold the torn paper as described above it would be no different in results of a catch/plug than what is currently sold.

Other then the standard tip bought or torn from business cards or magazines smokers use no tip or a fiber based filter like in cigarettes. There are a few other more complex, expensive, and less disposable filters, catches, and tips. None other then what has been mentioned above are single use disposable.

Applicant believes that the closest reference corresponds to U.S. Pat. No. 9,179,706 issued to Jepperson on 10 Nov. 20. However, it differs from the present invention because it lacks the corrugation disclosed in the present invention. The corrugations are important for ensuring adequate and consistent air flow through the filter when hand rolling a cigarette.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

SUMMARY OF THE INVENTION

It is one of the main objects of the present invention to provide a cigarette filter that is easy to use with hand rolling techniques without a machine.

It is another object of this invention to provide a cigarette filter that easily produces consistent airflow so that drag strength remains constant from cigarette to cigarette.

It is still another object of the present invention to provide an easy to hand roll combination of a pre-gummed rolling paper with attached corrugated filter.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
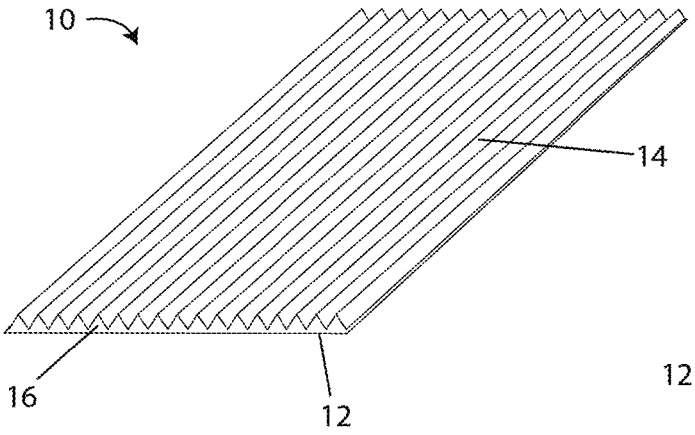
FIG. 1 shows a perspective view of a filter sheet.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the filter, the cigarette, the tip, machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes a backing 12, corrugations 14, airspace 16, perforations 18 and a paper 20.

Figure 2:
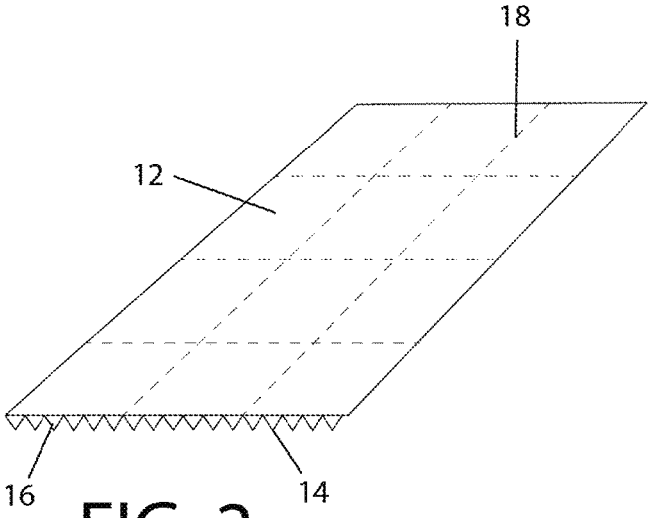
FIG. 2 shows a perspective view of a filter sheet.

A version of the invention is shown in FIGS. 1 and 2 where the top and bottom side of the yet unrolled tip can be clearly seen. This mode of the invention is as it might be distributed and prior to folding for actual use in a cigarette. The tip is generally constructed of a backing 12 with corrugations 14 on one face. The corrugations 14 surround and define an airspace 16. The airspace 16 is elongated and essentially forms a small tube. There are many parallel corrugations 16 along a face of the backing 12, each forming a tube.

On the face of the backing 12 opposite the corrugations 14 are optionally perforations 18. Perforations 18 may equally be characterized as scores or indentations in the backing. For example, instead of or in addition to tiny perforation holes the backing could be kiss-cut in a predefined pattern.

The perforations 18 may be used by a cigarette roller to tear the backing into a desired dimension or may guide the user where to make cuts to reduce the size of the filter backing 12. This is particularly useful if the filter is provided in a sheet or roll format with sufficient material to fabricate into multiple filters. The terms filter and tips are the same structure and therefore interchangeable terms.

Figure 6:
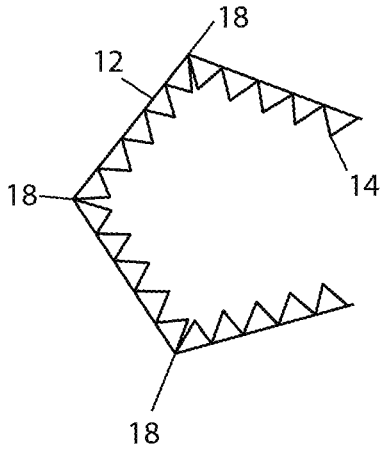
FIG. 6 shows an elevation view of an example of a filter partially through the rolling process.

Another benefit of the perforations 18 is seen in FIG. 6. These perforations 18 tend to help the user to roll the filter symmetrically into a cylinder instead of a cone. Essentially the perforations help to bend the backing 12 along a predefined line or series of parallel lines when folding into a usable tip.

Figure 3:
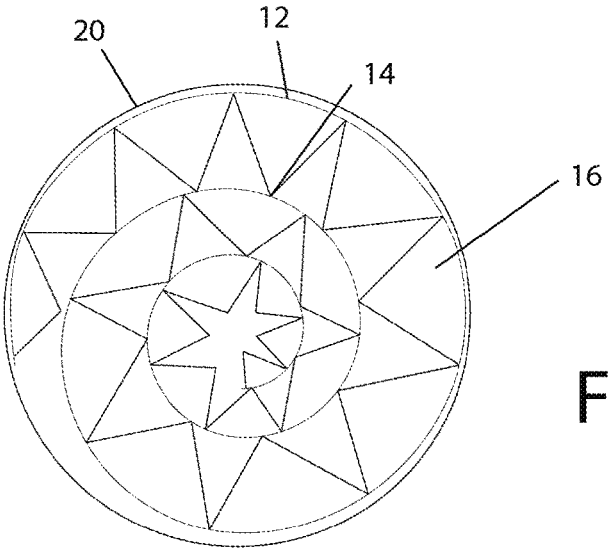
FIG. 3 shows an elevation view of a rolled cigarette.

FIG. 3 shows an example of a rolled cigarette viewed from the perspective showing the unlit end where the smoker inhales. The rolling paper 20 can be seen surrounding a coiled tip. This is exemplary of a section of a couple of squares of the tip sheet material shown in FIG. 2, separated about the perforation 18 lines.

The section of corrugated tip is coiled so that the airspace 16 tubes are parallel to the long axis of the cigarette. The crossectional dimension of the airspace 16 defined by the corrugations is small enough that tobacco particles will not be drawn through or clog the airspace 16 yet are large enough to allow air and tobacco smoke through the airspace 16 where it is delivered to the smoker.

FIG. 3 shows a plurality of airspaces 16 rolled about an imaginary central axis. The smoke can be drawn through the airspaces 16 simultaneously when the smoker draws a puff. None of the unburned tobacco gets into the smokers mouth. The tip also provides some structure that the smoker can hold between their fingers when smoking instead of the softer tobacco filled portion.

Typically the backing 12 and corrugations are made of a flexible material such as paper or cardboard. The corrugations 14 may be affixed to the backing 12 with adhesive. The size of the uncoiled tip may be, for example, about a half inch to a couple inches across the length of the corrugations 14 and about a half inch to an inch along the length of the corrugations 14. These dimensions are approximate for about a standard size cigarette and may be adapted larger or smaller for different sized cigarettes as is appropriate.

The tip material including the backing 12 with corrugations 14 may be provided in a sheet format or in a roll. The sheets could be pre-dimensioned to the size needed for one cigarette or larger where the end user separates the sheet into the desired size. Rolls could also be perforated so that the user can tear off or cut the appropriate sized tip for rolling into a cigarette.

Figure 4:
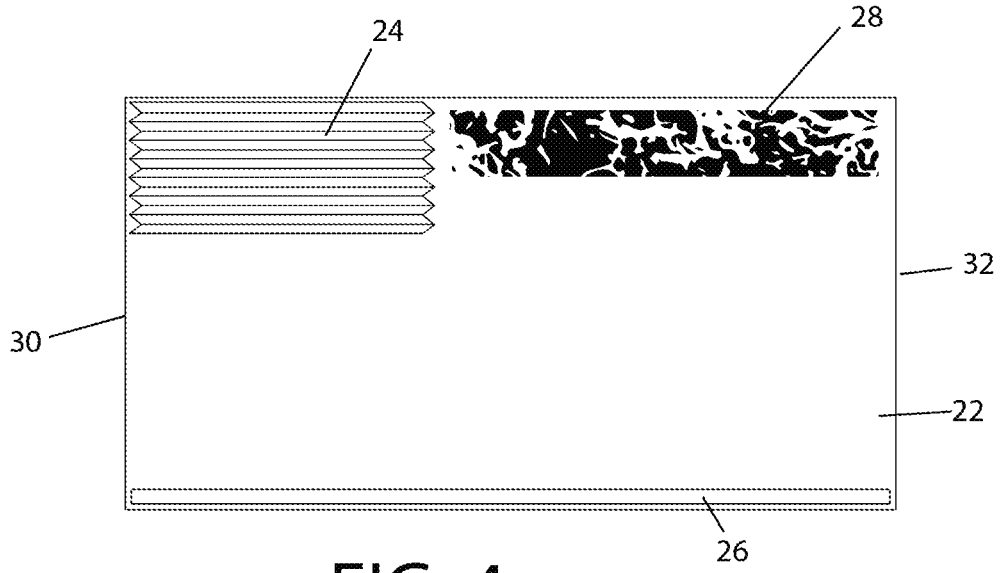
FIG. 4 shows a plan view of a prepared rolling paper with pre-attached filter.
Figure 5:
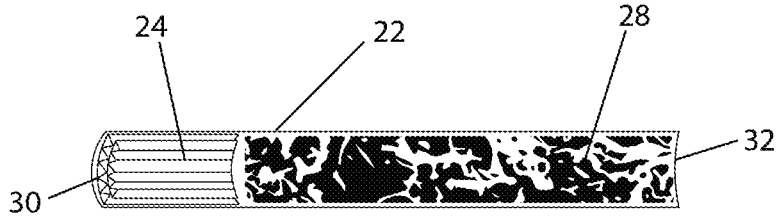
FIG. 5 shows an elevation cross-section of a completed cigarette.

FIGS. 4 and 5 show a version of the invention that is comprised of a paper 22, corrugations 24, a gum 26, tobacco 28, an edge 30 and an edge 32. The corrugations 24 are similar in format and materials to the sheet shown in FIG. 1.

The paper 22 is similar to a cigarette rolling paper in that it is made of a thin smokable paper with a gum 26 along a longitudinal edge. Opposite the gum 26 edge and adjacent to edge 30 is adhered a corrugation 24. The backing of the corrugation faces the same side of the paper 22 as the gum 26. The corrugation 24 are oriented parallel to the gum 26.

Generally, the paper 22 is provided presized for a preselected size cigarette and with the corrugations 24 affixed to a surface of the paper 22 and the gum 26 pre-applied. The user of the device then adds their own tobacco 28 away from the corrugations 28 and continues to roll the cigarette normally. In this way the tip comprised of the corrugations 24 are automatically integrated into the edge 30 of the cigarette.

The invention fits in the opposite end of ignition to serve as a tip and stop loss for filler in a rolled up cigarette without any folding required. This design is a complete improvement that can be used easier and more effectively then anything else out in the market.

When used at the end of a rolled smoking product it will catch filler from falling out the opposite of the ignited end as well as serve for a sturdy tip that can be held by the finger tip to allow the user to smoke all the filler without waste. There is no loss of filler when packing tobacco or other smoking material rolled with this invention.

One method to make the present invention is done by using corrugated paper of specific thickness and composition. A gum or glue may be applied to the flat side of the corrugated paper. By applying an adhesive or gummed portion to the flat side of corrugated material when attached to rolling paper and rolled into its own corrugation it will automatically wrap the paper around the filler at the same time thus achieving one of the simplest methods of forming a shape that can be ignited and smoked from the opposite end of any desired rolling paper without any risk that the filler could be sucked or dropped out.

When corrugated paper is rolled into itself, it does so naturally forming a cylinder. When attached to a wrap like paper (i.e. cigarette paper) it forces the paper to form the same cylinder like shape. Ideally this would be available in a small width roll that could be cut to size.

The filter would be rolled into a cylinder like shape varying in thickness as determined by the size of paper that was being used. This would serve as a custom sized tip or filter at the end of anything combustible that is rolled into a smoking stick. Any user could cut to size what would roll into a custom sized tip or filter. A roll could be unrolled through a dispenser that manually cuts too.

A tip dispenser may be provided with a roll of tips or filters that would be wrapped around a center core and dispensed through a small feed hole. Along the top of this feed hole would optionally be a blade on a slide that could be slid across and back to achieve the cleanest cut possible when dispensing custom sized tips or filters. The mechanism could be removable and the blade could further be but not necessarily need to be removable from the slide mechanism.

In at least one version of the invention the tip is attached to unrolled rolling paper opposite the gum side. It is attached on a side about fifteen or twenty percent of the rolling paper length, allowing room for the tobacco. The longitudinal aspect of the corrugations will lay the long ways across, parallel to the gum strip. It is bump/flute side out with the flat side against the paper. It covers about twenty five to eighty five percent of the width of the paper starting on the non-gummed edge leaving the gummed edge exposed.

When the filter is rolled into itself while attached to paper it should also roll the paper. The exposed gummed edge should be exposed enough that it is able to come over the sides of the back end completely so none of the filter is exposed except the tip.

Attach corrugated paper to rolling paper by applying an adhesive to the flat side of the corrugated paper. When a rectangle of corrugated paper is rolled up, it would serve as a tip. This tip would allow a user to smoke all the filler down to the filter without burning ones fingers while holding the filter while smoking and sucking. It is different from existing tips as it also functions as a catch or plug to keep any filler that is rolled in the smoking stick from falling out during the process of packing.

It serves as the ideal plug. During the act of packing, this tip serves as a plug in such a way that it is superior by design then other disposable items currently in the market. When rolling from scratch one may choose to condense what they roll, which is to pack the filler in the rolling paper so the filler is tighter throughout the whole smoking stick.

Often the method to pack smoking sticks is to drop them vertically on something filter/tip side down. Another method is to grab the opposite end from where this invention would be inserted with the thumb and index finger, then hold it in the air, straight down, and shake it side to side. If this procedure is administrated without this device a user cannot receive the same consistent results packing in the filler without risk of filler falling out.

The self-rolling filter/tip rolls into a cylinder shape that can be inserted into, or rolled into rolling paper. When used at the opposite end of ignition in the rolling paper rolled with filler, air is still able to pass easily through while preventing any of the filler from passing through at the same time.

When applying an adhesive or gummed portion to the flat side of corrugated material it can be done either in full, half, just the tip, or in some other degree or shape. When attached to rolling paper and rolled into its bumps or flutes the rolling paper will roll at the same time. When using gum this can be moistened slightly and then attached to the rolling paper.

Corrugated paper pre-cut with a gum applied to the flat back side would allow the user to attach this tip to any rolling paper. Gum on the corrugated paper is effective on the flat side running the parallel length of the flutes in the corrugated paper. The gum on the back could cover the entire back or partially to any degree to receive different desired results and after the corrugated paper is attached to the rolling wrap like paper, the paper itself becomes easier to roll.

When the tip is attached to a rolling paper it aids in rolling in a way that rolls into itself so the paper to which it is attached rolls with it. This can be done by simply applying pressure to the filter/tip/crutch against a surface or between two fingers and rolling it into itself, stopping before the gum on the rolling paper, and then wetting across the gum then complete rolling for a smoking stick every time.

Any of the rolling and packing methods could be used at the end of rolling paper to provide maximum air flow with no risk of matter or filler being pulled through when used at the opposite end of an ignited smoking stick. This is superior to the current accordion or folding methods.

When a fiber based substance is put inside the air pockets or flutes of the corrugation it can serve as a filter. The hollow flutes of corrugated paper may optionally be filled with a fiber like material to serve as a filter. When such filter is dispensed in a roll it is a custom or selected sized filter that can be dispensed and cut or torn at the perforations to any size to be rolled to any thickness.

The plain tip or filter-tip can be attached at the end of rolling papers that have already been pre-rolled into the shape of cylinders or cones. Different preselected combinations of the designs or different size width and length of the tip may be used.

The tip could include both fire safe treated paper and/or untreated paper. Other optional enhancements include flavored paper, scented paper. It could also include flavors or other additives to the gum when used. It could be made out of various types of pulp.

Other then a roll the tips can also be available in a sheet that could be cut up or torn by the user, a book of tabs that can be torn out by the user, a roll that pulls out for length and can be cut or torn to size and put in a dispenser or pre-rolled cylinders that can be used at the end of rolling papers.

A version of the device may be embodied as a rectangular shape with bumps or corrugation on the top layer. It could roll into itself to form a cylinder. There would be no folding needed to cache most of the plant material when a user sucks on the non-ignited end. The inside of the cylinder would resemble a honeycomb and have numerous airways based on the thickness of the cylinder the user would roll up. The thickness of the made cylinder would depend on the length of the rectangle the user started with. It could be cut to various sizes to the users liking.

Paper that is made flat on one side and having corrugations on the other can be rolled into the bumpy side to form a cylinder that can then be inserted into rolling papers to contain plant matter. It can then be ignited on the opposite end where as the user would smoke the cigarette. The design of said device provides air flow as it prevents any type of filler from being sucked or pulled through while a said user ignited the opposite end and sucks through smoke and or vapor.

Perforated corrugated strips use perforations or shallow slits in the paper along either the longitudinal or transverse dimension. They may be partial or from one end of the strip to the other end. This can be from a roll or in a form that tears into a strip. It can be torn into various size strips that most sizes could be then rolled into a cylinder like shape.

The perforations could be torn or could be made so they don't tear and just bend the corrugated paper more easily. Without perforations, laddered scores running the short length approximately every half inch or less along the backing of the corrugated strip when folded into a roll or cylinder creates more force or pressure to maintain its cylindrical shape profile.

A plastic dispenser to contain a roll or strip of perforated corrugated paper would need no metal components to cut. The perforations would serve as an aid that if such dispenser opened and shut with a firm plastic edge it would be enough pressure to break the perforation and cut the strip to a size that would be determined by the length of the strip pulled forward before the container was shut separating the strip pulled out from the remainder in the container. This can be done with a small cylinder that is an inch or so thick but could be a lot less. A shallow score or kiss-cut could be used as an alternative or in addition to any of the perforations described herein.

A version of the invention can be fairly described as a cigarette tip comprised of a backing and corrugations. The corrugations are adhered in parallel to a first surface of the backing. A portion of the corrugation is separated from the first surface of the backing creating an airspace channel in each corrugation through which smoke is drawn. The airspace channels are parallel. A second surface of the backing, opposite the corrugations, has a perforation or a score that is perpendicular and/or parallel to the airspace channel. The perforation or score is adapted to bias a fold along a longitudinal length of the perforation or score when rolling the cigarette tip in the process of rolling a cigarette. The cigarette tip may further be characterized in that each of the airspace channels are filled with a filter material, such as cotton or synthetic fibers. The cigarette tip may include that the second surface of the backing is adhered to a first surface of a cigarette paper adjacent to both a first longitudinal edge and second transverse edge in the corner. The first surface of the cigarette paper includes a gum along an entire third longitudinal edge to seal the finished cigarette. The airspace channels through which the smoke is drawn are parallel to the first longitudinal edge of the cigarette paper.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cigarette tip comprised of a backing and corrugations;

the corrugations are adhered in parallel to a first surface of the backing;

a portion of the corrugation is separated from the first surface of the backing creating an airspace channel in each corrugation;

the airspace channels are parallel;

a second surface of the backing has a perforation or a score that is parallel to the airspace channel;

the perforation or score in the backing is parallel to the airspace channels and is adapted to bias a fold along an entire length of the backing;

the cigarette tip is coiled with the backing exterior to the corrugations to form a cylinder without any fibrous filter material outside of the airspace channels;

each of the airspace channels between the backing and the corrugations are filled with a fibrous filter material.

* * * * *